US010054313B2

(12) United States Patent
Portillo Bilbao et al.

(10) Patent No.: US 10,054,313 B2
(45) Date of Patent: Aug. 21, 2018

(54) AIR BIASING SYSTEM IN A GAS TURBINE COMBUSTOR

(75) Inventors: Juan Enrique Portillo Bilbao, Oviedo, FL (US); Scott M. Martin, Daytona Beach, FL (US); David M. Ritland, Winter Park, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1993 days.

(21) Appl. No.: 12/832,099

(22) Filed: Jul. 8, 2010

(65) Prior Publication Data

US 2012/0006029 A1 Jan. 12, 2012

(51) Int. Cl.

| | |
|---|---|
| ***F23R 3/14*** | (2006.01) |
| ***F23R 3/28*** | (2006.01) |
| ***F23R 3/26*** | (2006.01) |
| ***F23R 3/54*** | (2006.01) |

(52) U.S. Cl.

CPC ..... *F23R 3/286* (2013.01); *F23R 3/14* (2013.01); *F23R 3/26* (2013.01); *F23R 3/54* (2013.01); *F23R 2900/00013* (2013.01)

(58) Field of Classification Search

USPC ..... 60/737, 738, 748, 760, 39.23, 746, 747, 60/804

See application file for complete search history.

(56) References Cited

U.S. PATENT DOCUMENTS

| | | | | |
|---|---|---|---|---|
| 5,197,290 | A | 3/1993 | Lee et al. | |
| 5,277,023 | A | 1/1994 | Bradley et al. | |
| 5,628,182 | A | 5/1997 | Mowill | |
| 5,735,681 | A | 4/1998 | Cheng | |
| 6,253,538 | B1 | 7/2001 | Sampath et al. | |
| 6,269,646 | B1 | 8/2001 | Lovett et al. | |
| 6,920,758 | B2 * | 7/2005 | Matsuyama et al. | 60/725 |
| 6,931,853 | B2 | 8/2005 | Dawson | |
| 6,966,186 | B2 | 11/2005 | Bachovchin et al. | |
| 7,181,916 | B2 * | 2/2007 | Ziminsky et al. | 60/776 |
| 7,631,499 | B2 * | 12/2009 | Bland | 60/747 |
| 2004/0093851 | A1 | 5/2004 | Dawson | |
| 2006/0263731 | A1 | 11/2006 | Hasegawa et al. | |
| 2007/0119183 | A1 | 5/2007 | Evolut | |
| 2008/0072605 | A1 | 3/2008 | Hagen et al. | |
| 2008/0163627 | A1 | 7/2008 | ELKady et al. | |
| 2009/0255259 | A1 | 10/2009 | Kastrup et al. | |

OTHER PUBLICATIONS

Lefebvre, Arthur H. and Ballal, Dilip R; Gas turbine combustion: alternative fuels and emissions; 2010; Taylor & Francis Group, LLC; 3rd edition; p. 114-143.*

* cited by examiner

*Primary Examiner* — Arun Goyal

(57) ABSTRACT

A combustor (10) including: a first premix main burner (14) comprising a first swirler airfoil section (38); a second premix main burner (15) comprising a second swirler airfoil section (40); and a supply air reversing region upstream of the premix burners (14), (15). The first swirler airfoil section (38) and the second swirler airfoil section (40) are effective to impart swirl to a first airflow and a second airflow characterized by a same swirl number as the airflows exit respective burners (14), (15). The combustor (10) is effective to generate a first airflow volume through the first premix main burner (14) that is different than a second airflow volume through the second premix main burner (15).

19 Claims, 4 Drawing Sheets

AIR BIASING SYSTEM IN A GAS TURBINE COMBUSTOR

FIELD OF THE INVENTION

The invention relates to controlling combustion dynamics in a gas turbine engine. More particularly, this invention relates to controlling combustion dynamics by biasing airflow to a combustion flame in the gas turbine engine.

BACKGROUND OF THE INVENTION

Gas turbine engines are known to include a compressor for compressing air, a combustor for producing a hot gas by burning fuel in the presence of the compressed air produced by the compressor, and a turbine for expanding the hot gas to extract shaft power. Gas turbine engines using annular combustion systems typically include a plurality of individual burners disposed in a ring about an axial centerline for providing a mixture of fuel and air to an annular combustion chamber disposed upstream of the annular turbine inlet vanes. Other gas turbines use can-annular combustors wherein individual burner cans feed hot combustion gas into respective individual portions of the arc of the turbine inlet vanes. Each can includes a plurality of main burners disposed in a ring around a central pilot burner.

During operation, the combustion flame can generate combustion oscillations, also known as combustion dynamics. Combustion oscillations in general are acoustic oscillations which are excited by the combustion itself. The frequency of the combustion oscillations is influenced by an interaction of the combustion flame with the structure surrounding the combustion flame. Since the structure of the combustor surrounding the combustion flame is often complicated, and varies from one combustor to another, and because the combustion flame itself may vary over time, it is difficult to predict the frequency at which combustion oscillations occur. As a result, combustion oscillations may be monitored during operation and parameters may be adjusted in order to influence the interaction of the combustion flame with its environment.

A combustion flame emits sound energy during combustion. A more uniform flame will generate more uniform acoustics, but perhaps with higher peak amplitude at a particular frequency than a less uniform flame. When an emitted frequency of combustion coincides with a resonant frequency of the combustion chamber the system may operate in resonance, and the resulting combustion dynamics may damage the gas turbine components, or at least reduce their lifespan.

One known way to reduce the interaction of the combustion flame with the combustion acoustics is to reduce the coherence of the flame, i.e. reduce the spatio-temporal uniformity of the flame. A flame with less uniform combustion throughout its volume is likely to perturb the gas turbine less than a uniform flame because the energy released is spatially distributed and therefore decreases its coupling to the system resonant frequencies or acoustic modes. This is the well known Rayleigh criterion. As a result, combustion dynamics of flames with less uniform combustion throughout its volume are less likely to be exacerbated than by a more uniform flame.

One way that has been utilized to reduce flame coherence has been to vary the fuel/air ratio throughout the flame. Main premix burners often have a swirler that swirls an airflow flowing through the burner. Fuel outlets in the burner introduce a flow of fuel into the airflow to produce a fuel/air mixture of a certain ratio. The fuel/air ratio from main burners may be varied. For example, some of the main burners of a combustor may be controlled by one fuel stage, and the remaining burners of the combustor by another stage. Since the structure of the main burners and swirlers in them are uniform throughout the burners in the combustor, varying the fuel from burner to burner varies the fuel/air ratio. Since each fuel/airflow has a different amount of fuel when it reaches the combustion flame, the combustion/temperature of the combustion flame varies throughout its volume and the flame is less coherent.

Such a fuel biasing of the combustion flame has drawbacks. Separate fuel stages are very expensive to manufacture and complicated to operate. Further, localized regions of leaner and richer combustion within the combustion flame produce less than optimal emissions.

Another way that has been utilized to reduce flame coherence has been to vary portions of the combustion flame axially with respect to other portions of the combustion flame which results in a less uniform combustion flame, thereby reducing combustion dynamics. This has been accomplished, in one example, by increasing the volume of fuel/air flow through one burner with respect to another burner. This has also been accomplished by positioning burners in different locations axially with respect to other burners in a combustor. However, these configurations may not work under all situations, so there remains room in the art for combustor configurations to reduce flame coherence and associated combustion instabilities.

BRIEF DESCRIPTION OF THE DRAWINGS

The invention is explained in the following description in view of the drawings that show.

DETAILED DESCRIPTION OF THE INVENTION

The inventors have devised an innovative way to configure a combustor utilizing premix main burners (i.e. burners) so that different burners will deliver fuel/air flows having a differing parameter which will, in turn, reduce flame coherence and associated combustion dynamics. The differing parameter need not be the fuel/air ratio, so that combustion dynamics may be controlled without sacrificing optimized emissions.

Each fuel/air flow may be characterized by the same swirl number but a different mass flow rate. The swirl number (S) is defined as the ratio of the axial flux of the angular momentum ($G_\phi$) to the axial thrust ($G_x$) times the exit radius (R), $$S \equiv \frac{G_\phi}{G_x R}.$$

In an embodiment the fuel/air flows emanating from each burner may have the same fuel/air ratio. As a result of a uniform fuel/air ratio from burner to burner, localized areas of varying temperature within the combustion flame may be reduced or eliminated. By eliminating these localized areas, the less than optimal emissions associated with them are also eliminated.

A different flow from one burner to the next may result from directing differing flows to respective burners, or by varying the geometry within a burner to influence the airflow there through, or both. Maintaining the same fuel/air ratio may be accomplished by mechanically configuring each fuel outlet to produce this result, or by fuel control via staging, or a combination of both.

Figure 1:
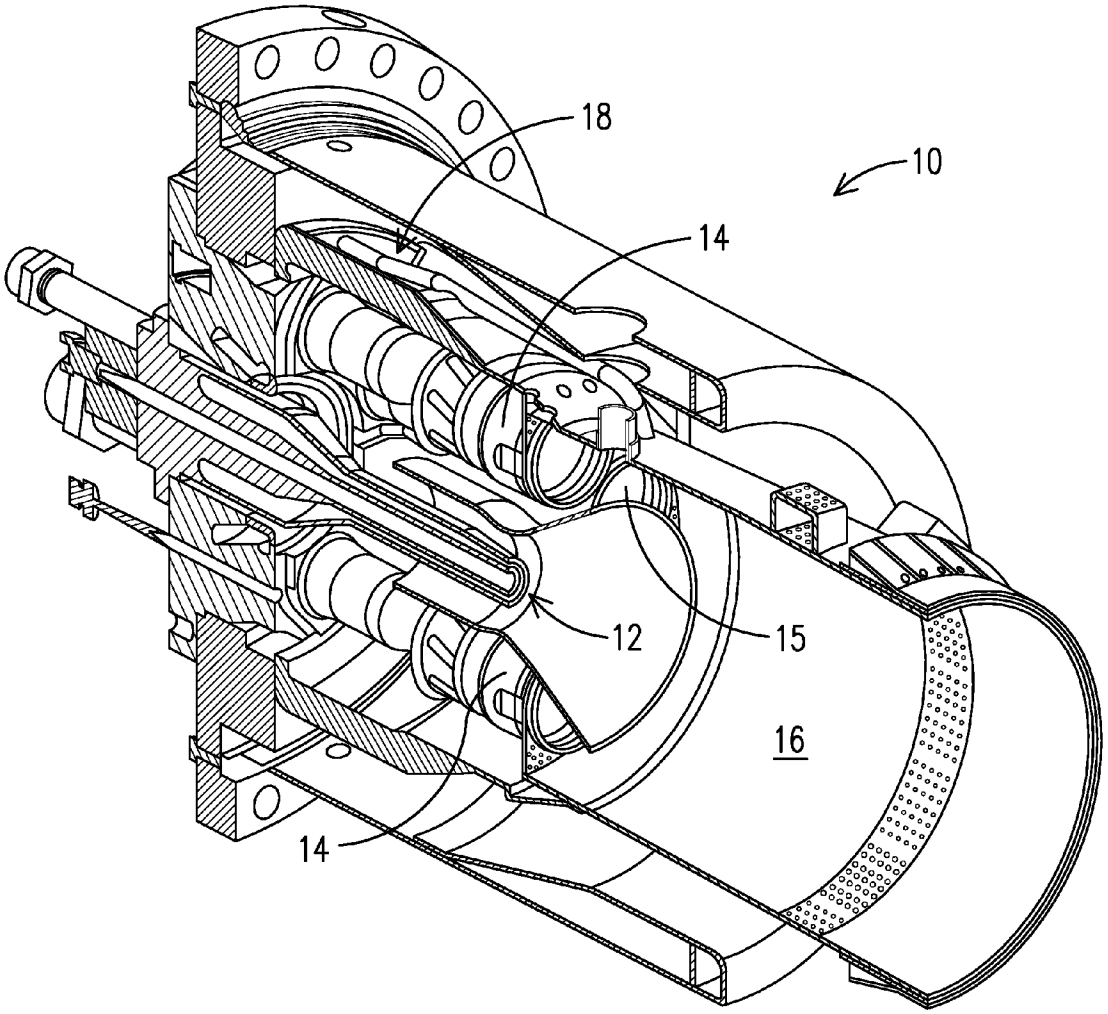
FIG. 1 shows a cutaway of a combustor of a gas turbine engine with a pilot burner and main burners.

FIG. 1 shows a cutaway of a combustor 10 of a gas turbine engine. Inside the combustor 10 is a pilot burner 12, and a plurality of premix main burners 14, 15 disposed around the pilot burner 12. Inside each main burner 14, 15 is a swirler (not visible) that imparts a swirl to a flow flowing through each burner. Also inside each burner is at least one fuel outlet (not shown) that directs fuel into the airflow flowing through the main burner 14, 15. The airflow is delivered from an upstream region 18. A combustion flame (not shown) occurs in the combustion region 16 where the fuel/air flow from the pilot burner 12 and swirled fuel/air flows from the main burners 14, 15 converge during operation. It can be seen that if each fuel/air flow from the main burners is uniform, then the combustion flame is likely to be more uniform. Thus, by varying the fuel/air flow from each burner the resulting combustion flame may be less uniform.

Figure 2:
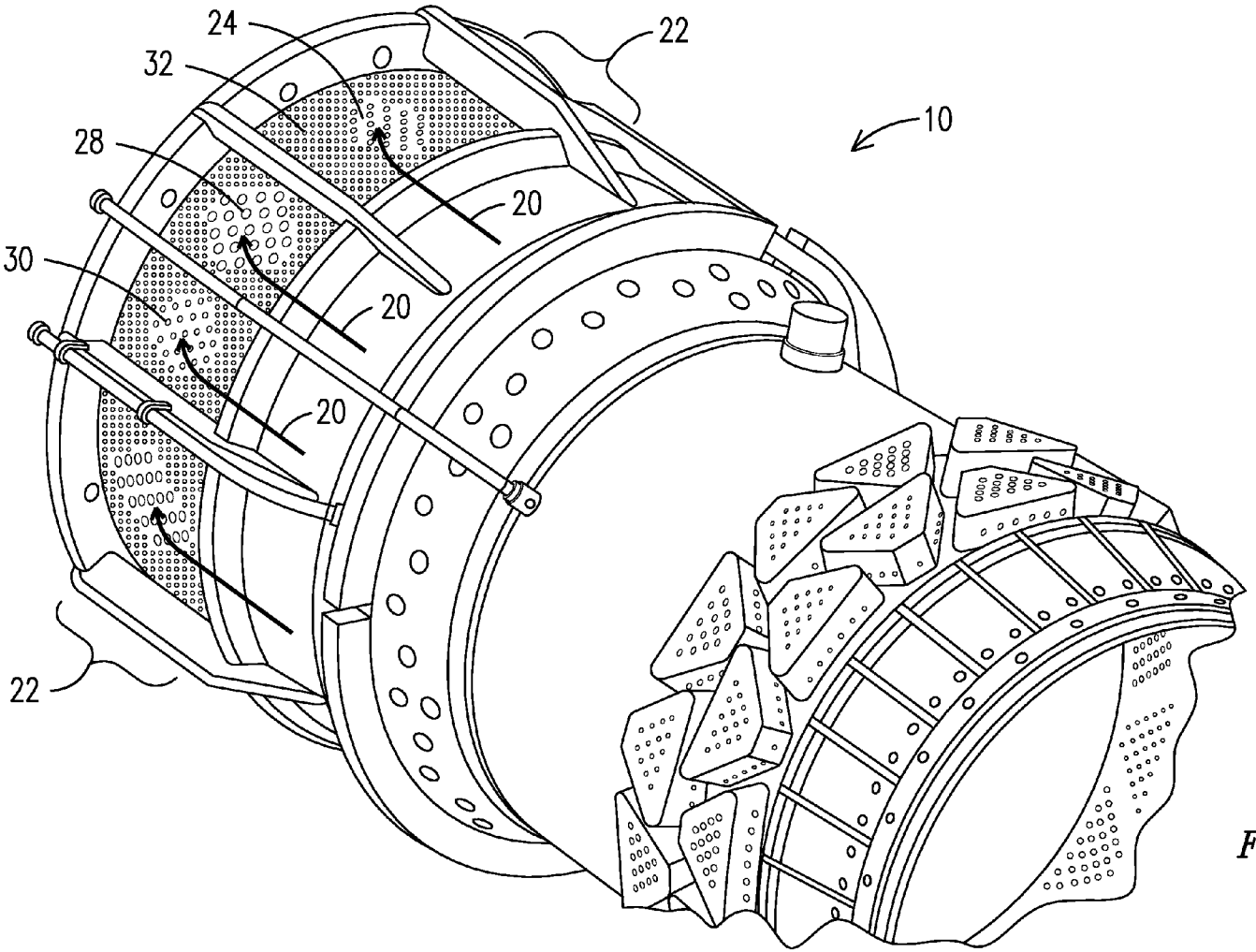
FIG. 2 shows a combustor with a flow conditioning plate disposed in a flow reversing region.

As can be seen in FIG. 2, supply air 20 originates outside the combustor. In this configuration supply air 20 flows into a reversing region 22 where it reverses direction and enters the upstream region, 18 of the combustor 10. In this embodiment flow conditioning plate 24 is disposed in the reversing region 22, transverse to the flow of supply air 22, such that the supply air 20 must flow through circumferentially disposed openings in the flow conditioning plate 24 in the reversing region 22 before entering upstream region 18 of the combustor 10. In order to direct portions of the supply air 20 to the main burners 14, 15, the flow conditioning plate 24 may have uniform holes of differing sizes and asymmetric positioning throughout the flow conditioning plate 24. For example, there may be larger holes 28, smaller holes 30, and uniform holes 32. Larger holes 28 may be disposed in the flow conditioning plate 24 where necessary to permit a relatively larger mass flow rate of airflow to a chosen main burner. This location may be wherever necessary in the supply air 20 flow to produce the desired airflow at the chosen main burner downstream. Likewise, smaller holes 30 may be disposed in the flow conditioning plate 24 where necessary to permit a relatively smaller mass flow rate of airflow to a specified main burner. The remainder of the flow conditioning plate may comprise uniform holes 32 or no holes at all. Any configuration of holes and hole sizes that results in a non-uniform axial cross section of supply air 20 flow inside the combustor 10 upstream of the burners 14, 15 is envisioned, as this would enable different amounts of air flow to different burners 14, 15. In other words, a different percentage of the total supply air volume can be directed to different burners. In this manner, the flow delivered to respective main burners 14, 15 can be different, which in turn will result in different flows from respective main burners 14, 15 into the combustion flame. Different flows into the combustion flame will reduce flame coherence, which will reduce combustion dynamics.

When the flows into the main burners 14, 15 are conditioned in this manner the swirlers (not shown) within the main burners 14, 15 may be the same throughout all the main burners 14, 15. In this manner the respective flow of air that does make it to a particular burner will be subject to the same swirl as other flows. The only thing that will change is the mass flow rate of air flowing through the particular burner with respect to other burners. As a result this configuration for conditioning respective flows lends itself well to a retrofit application, where a flow conditioning plate 24 may be installed on existing combustors 10. Adding a flow conditioning plate 24 to existing combustors 10 is a simple and relatively inexpensive way to condition the supply flow 20 into flows tailored for respective burners. Since most combustors 10 that could be retrofitted in this manner already have fuel staging, the fuel staging may be adjusted as necessary to produce the same fuel/air ratio from each burner, which would reduce or eliminate varying temperature within the combustion flame, thereby reducing emissions. It is also envisioned where the fuel/air ratio may still be varied in fuel/air flows from burner to burner. This provides an added degree of control and/or fine tuning. Similarly, the fuel/air ratio may be adjusted during operation such that at times the fuel/air ratios of all the respective flows are the same, and at other times, the fuel/air ratio of all the respective flows are different. This may be necessary when other factors are considered, such as transient operating conditions etc. It is also envisioned that the flow conditioning plate 24 may be used in conjunction with the teachings below.

Further, for sake of simplicity it has been assumed that the supply air 20 may have an essentially uniform pressure throughout its volume before being conditioned when a flow conditioner 24 is used. The same assumption is made about the region into which the airflows leaving the burners flow. This simplification contributes to a more ready understanding of the invention because the pressure drop from before the conditioning plate 24 to the region downstream of the burners would be the same regardless of what path the supply air takes between the conditioning plate 24 and the region downstream of the burners. Thus it is easier to envision how different burner/swirler geometries may influence the flow through the respective burner. Similarly, in embodiments where no conditioning plate 24 is used, it is assumed that the supply air 20 may have an essentially uniform pressure throughout its volume before entering respective burners, and after leaving the burners. Here again it is easier to envision how different burner/swirler geometries may influence the flow through the respective burner. However, the inventors understand that pressure variations may occur throughout the volumes of each of these areas of assumed uniform pressure, and these pressures and locations of pressure variations may change during operation. In embodiments where all main burner fuel outlets are controlled by a single stage and uniform fuel/air ratios among all flows are desired, it is understood that perfect uniformity for fuel/air ratios may not always be achieved. Such operating variations are envisioned and may be tolerable, depending on the design. Such variations are likely to be less than variations present in existing fuel biasing combustors, and so combustors as disclosed herein are still likely to have improved emissions when compared to fuel biasing combustors. Minor lack of uniformity may be tolerable if, for instance, the cost saving associated with a single stage controlling the fuel to all the main burners 14, 15 is preferred. When more uniformity is desired then staging the control the fuel among the main burners may be preferred, despite the added cost.

Figure 3:
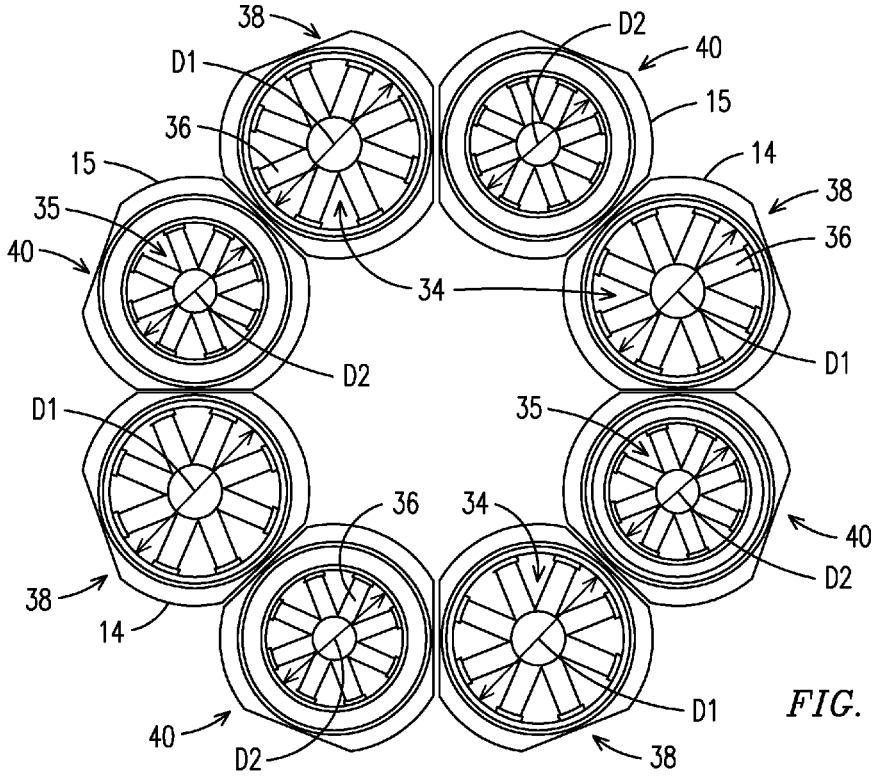
FIG. 3 schematically shows main swirlers of different diameters in a combustor.

FIG. 3 is a partial cross section of the main burners 14, 15 as they would be positioned in a combustor 10. Visible are swirlers 34, 35. Each swirler has airfoils 36 which swirl air flowing through the burner, and therefore through the swirler 34. In an embodiment, the swirlers 34, 35 may have different diameters, D1, D2, but be aerodynamically proportional so that although there will be different mass flow rates of air flow through respective swirlers, each will be characterized by the same swirl number. Due to the design of combustors 10, supply air 20 must flow through one of the main burners 14, 15 or the pilot burner 12. Thus, a different swirler diameter will permit a different percentage of the total supply air 20 to pass through the swirler 34, 35. Each fuel/air flow produced will be characterized by the same swirl number, but the diameter of the fuel/air flow, and therefore the total mass flow rate of fuel/air flow exiting a main burner swirler will be different from the fuel/air flow exiting from another main burner swirler. As a result, different sized fuel/air flows will be entering the combustion flame at different locations of the combustion flame, and the combustion flame coherence will be reduced. This reduced coherence will reduce combustion dynamics. There may be two different diameters, and these may be staggered or otherwise grouped, or there may be a different diameter for each swirler 34, 35. For example, in an embodiment a first premix main burners 14 may comprise a larger diameter (D1) swirler 34 and form a first swirler airfoil section 38, and second premix main burner 15 may comprise a smaller diameter (D2) swirler 35 and form a second swirler airfoil section 40. These may be arranged in an alternating pattern, or grouped together in other patterns, though these examples are not meant to be limiting.

When the diameters of respective swirlers differ, but the swirlers are aerodynamically proportional, the fuel/air ratio of the flows from respective burners can be varied or can be the same. In an embodiment where the same fuel/air ratio is desired for all flows, this can be accomplished by mechanically configuring the respective fuel outlets without the need for staging among the main burners 14, 15, or by utilizing staging among the main burners 14, 15, or both. In an embodiment where the fuel/air ratio is to be the same from burner to burner, and the fuel outlets are mechanically configured to produce consistent fuel/air ratios throughout, multiple stages of fuel to control fuel to the main burners 14, 15 may not be needed. This is particularly advantageous because fuel staging is expensive to manufacture, operate and maintain. Eliminating a fuel stage for the main burners 14, 15 would result in a significant cost savings, without sacrificing the needed control over the combustion dynamics, and may even improve emissions over staged/fuel biasing schemes. Nonetheless, it is envisioned that staging among main burners 14, 15 may still be desired, and may afford a greater degree of control over combustion dynamics and emissions. The balance of cost versus desired control may determine which ultimate configuration is chosen, and this flexibility is the result of this innovative approach.

In another embodiment, the airfoils 36 of one swirler may be a different thickness than airfoils 36 of another swirler. If the remainder of the geometry is the same among swirlers, then the thicker blades of one swirler 36 will restrict the air flowing through that swirler. The mass flow rate of the air through the swirler is thus reduced, but the flow is characterized by the same swirl number as a flow emanating from a burner where the swirler airfoils 36 are relatively thinner. This can be seen in FIG. 4, which is a schematic representation of airfoils 36. Relatively thinner airfoils 42 of one swirler result in a larger flow path width 46 between airfoils 42. Relatively thicker airfoils 44 of another swirler result in a narrower flow path width 48 between airfoils 44. Thus, the mass flow rate of air flowing through a swirler with thinner airfoils 42 will be greater than a mass flow rate of air flowing through a swirler with thicker airfoils 44. There may be only two different airfoil thicknesses, or there may be as many airfoil thicknesses as there are swirlers.

This configuration may likewise be designed to produce the same fuel/air ratio in all fuel/air flows, or different fuel/air ratios. If the same fuel/air ratio is desired, the fuel outlets can be configured mechanically do produce the desired fuel/air ratios, without staging among the main burners 14, 15. The fuel may also be controlled with staging among the main burners 14, 15. Both techniques may also be used together to control fuel/air ratios.

Figure 4:
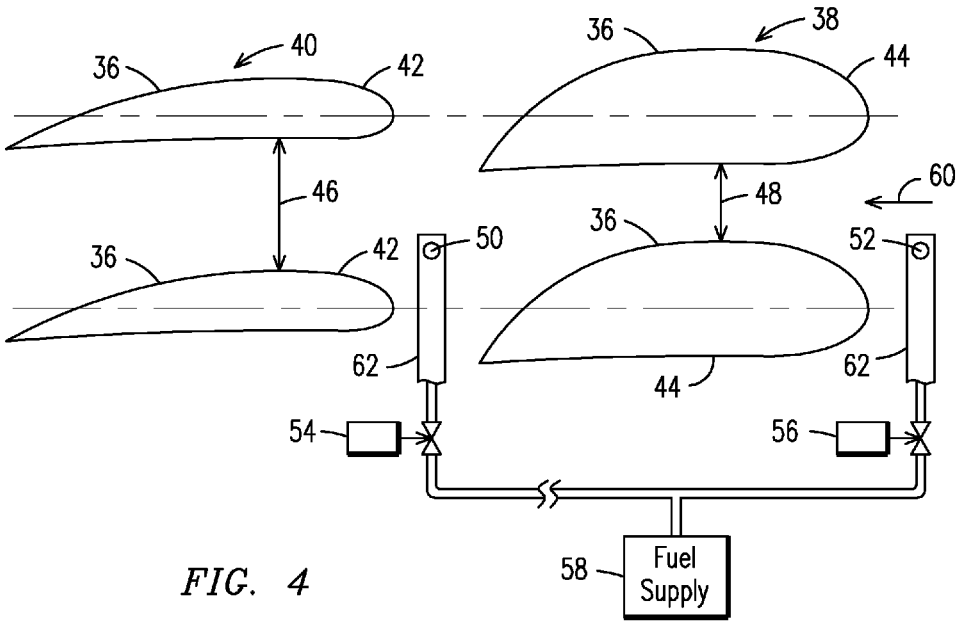
FIG. 4 is a schematic representation of swirler airfoils of differing thicknesses, and a staged fuel supply.

Also shown schematically in FIG. 4 are fuel outlets 50, 52, and respective stages 54, 56 for controlling a flow of fuel to each fuel outlet 50, 52 from a fuel supply 58. In an embodiment fuel may be injected into an airflow 60 via pegs 62 which are separate from the airfoils 42, 44. However, fuel can be injected into the airflow 60 in any number of ways, including outlets incorporated into the airfoil, and/or outlets upstream or downstream of the swirler.

Figure 5:
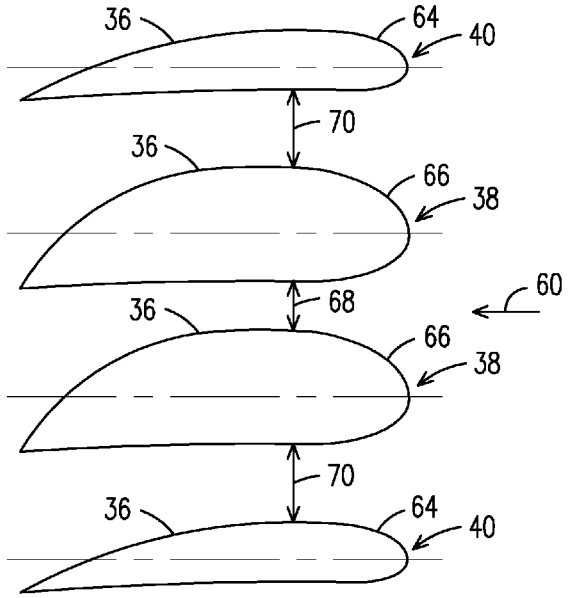
FIG. 5 schematically depicts air flow paths between a plurality of airfoils in an embodiment.

In another embodiment individual airfoils within one swirler may differ in geometry from other airfoils in the same swirler. Only one swirler may have airfoils of differing geometry, or as many as all of the swirlers may have airfoils of differing geometry. For example FIG. 5 schematically depicts air flow paths between a plurality of airfoils 36. It can be seen that there may be thinner airfoils 64 and thicker airfoils 66. Thinner airfoils 64 and thicker airfoils 66 may be grouped as shown, or in any configuration to achieve a desire effect. As shown, placing two thicker airfoils 66 next to each other will result in a smaller opening 68 between them than an opening 70 between a thinner airfoil 64 and a thicker airfoil 66. This will result in a reduced flow through the swirler, but the flow will be characterized by the same swirl number. The blade thicknesses can be varied in any number of ways to tailor the swirl as desired. Within a swirler there may be one common airfoil thickness, or there may be as many differing airfoil thicknesses as there are airfoils in that swirler.

Figure 6:
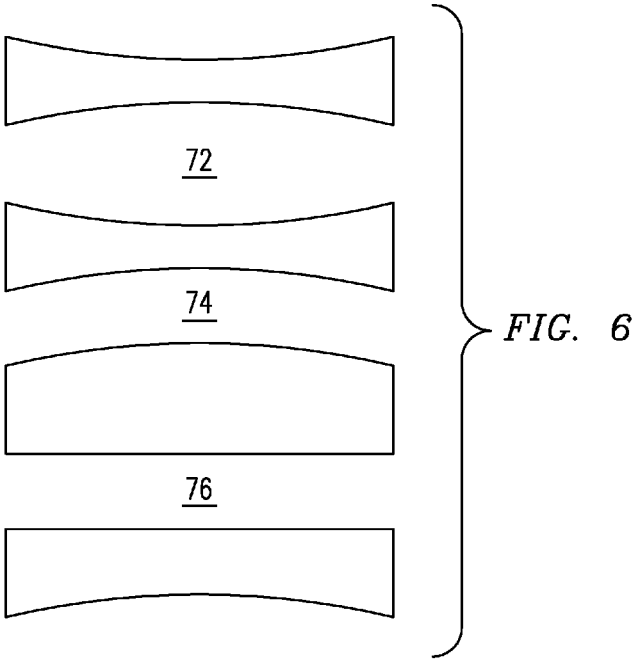
FIG. 6 is a schematic view of the flow paths between airfoil blades of an embodiment as seen by the air flowing through them.

In another embodiment the shape of the airfoil within the swirler differs from blade to blade within the swirler. For example, in the previous embodiments the discrete flow paths between adjacent airfoils in a swirler may have a rectangular cross section. As seen in FIG. 6, which is a schematic view of the flow paths between airfoil blades as seen by the air flowing through them, (i.e. the flow is flowing into the page), the shapes of the airfoils can be different in order to contour the discrete flow paths between airfoils. A cross section of discrete flow path 72 would be more rounded than a rectangular cross section of a traditional flow path. Similarly flow path 74 would be more arched, and flow path 76 would be more traditionally rectangular, and all these shapes can exist within the same swirler. Any combination is envisioned. Further, the shapes can vary in other ways than that shown in FIG. 6. The airfoils can vary along their length, width, and height. What matters is that the fuel/air flow exiting the swirler be characterized by the same flow number as the fuel/air flows exiting from other swirlers. Within a swirler there may be one common airfoil shape, or there may be as many differing airfoil shapes as there are airfoils in that swirler.

It can be seen that the inventors have devised an air biasing structure capable of reducing flame coherence, and associated combustion dynamics, in a manner not yet seen in the art. This structure provides greater design flexibility without sacrificing necessary control over combustion dynamics. Further, when the fuel/air ratio of all fuel/air flows flowing into the combustion flame are kept the same an entire stage of fuel controls for the main burners may be removed, saving substantial manufacturing and operating costs, while reducing emissions over fuel biasing schemes of the prior art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A combustor comprising:

a first premix main burner comprising a first swirler airfoil section;

a second premix main burner comprising a second swirler airfoil section; and a supply air reversing region upstream of the premix main burners, wherein the first premix main burner and the second premix main burner, collectively called premix main burners, constitute a part of an annular array of burners;

wherein the first swirler airfoil section and the second swirler airfoil section comprise respective airfoil geometries effective to impart swirl to a respective first airflow and second airflow that is characterized by a same swirl number as the airflows exit respective of the premix main burners, and wherein the first premix main burner comprises a first diameter, and wherein the second premix main burner comprises a second diameter that is different than the first diameter and is effective to generate a first airflow mass flow rate of the first airflow through the first premix rosin burner that is different than a second airflow mass flow rate of the second airflow through the second premix main burner.

2. The combustor of claim 1, comprising an annular supply airflow conditioning plate disposed upstream of the premix main burners and transverse to a supply airflow, through which the supply airflow flows; which is effective to deliver a different amount of the supply airflow to the first swirler airfoil section than to the second scarier airfoil section.

3. The combustor of claim 2, wherein the supply airflow conditioning plate comprises circumferentially spaced perforations arranged in a pattern effective to deliver the different amount of the supply airflow to respective of the premix main burners.

4. The combustor of claim 3, wherein the supply airflow conditioning plate is disposed in the supply air reversing region.

5. The combustor of claim 1, wherein a geometry of the first swirler airfoil section differs from a geometry of the second swirler airfoil section and a difference results in the first airflow mass flow rate that is different than the second airflow mass flow rate.

6. The combustor of claim 5, wherein a thickness of the first swirler airfoil differs from a thickness of the second swirler airfoil.

7. The combustor of claim 5, wherein the first swirler airfoil section comprises airfoils of differing geometry.

8. The combustor of claim 7, wherein a thickness of at least one of the first swirler airfoil differs from a thickness of another one of the first swirler airfoil.

9. The combustor of claim 7, wherein a shape of at least one of the first swirler airfoil differs from a shape of another one of the first swirler airfoil.

10. The combustor of claim 1, wherein the first premix main burner and the second premix main burner are configured to provide the first airflow and the second airflow, respectively, with the same fuel/air ratio when supplied by a single common fuel stage.

11. A combustor for a gas turbine engine, comprising:

a plurality of premix main burners arranged in an annular array, each premix main burner of the plurality of premix main burners each comprising a swirler, and a supply air reversing region upstream of the premix main burners, wherein each of the swirler is configured to produce swirled flow characterized by the same swirl number upon exiting respective of the plurality of premix main burners, and wherein the plurality of premix main burners comprises different burner diameters effective to result in a different percentage of total supply air volume flowing from one of the plurality of premix main burners than from another one of the plurality of premix main burners.

12. The combustor of claim 11, comprising an annular supply airflow conditioning plate, through which a supply airflow flows, disposed upstream of the premix main burners and transverse to the supply airflow flow, which is effective to deliver different percentage of total supply air volume to the one of the plurality of premix main burners than to another one of the plurality of premix main burners.

13. The combustor of claim 11, wherein different swirler geometry in the one of the plurality of premix main burners results in the different percentage of total supply air volume flowing from the one of the plurality of premix main burners than from another one of the plurality of premix main burners.

14. The combustor of claim 13, wherein a thickness of airfoils of at leas one of the swirler is different than a thickness of airfoils of another one of the swirler.

15. The combustor of claim 11, wherein each of the plurality of premix main burners comprises at least one fuel outlet effective to produce a same fuel/air ratio in each airflow when all fuel outlets are controlled by a single fuel stage.

16. The combustor of claim 15, comprising a separate fuel stage for the at least one fuel outlet.

17. The combustor of claim 11, comprising separate fuel stages.

18. An improvement for a gas turbine engine combustor comprising a plurality of premix main burners arranged in an annular array and an upstream airflow reversing region, the improvement comprising:

a combustor effective to produce an airflow from each premix main burner of the plurality of premix main burners, wherein each of the airflow is characterized by a same swirl number upon exiting the premix main burner, and wherein the plurality of premix main burners comprises different burner diameters effective to produce at least one airflow mass flow rate through a given burner of the plurality of premix main burners that is different from another airflow mass flow rate through a different burner of the plurality of premix main burners.

19. The improvement of claim 18, wherein a thickness of airfoils of at least one swirler is different, resulting in the different airflow mass flow rate.

* * * * *